US009732717B2

(12) United States Patent
Aurich et al.

(10) Patent No.: US 9,732,717 B2
(45) Date of Patent: Aug. 15, 2017

(54) NOZZLE NEEDLE FOR AN INJECTOR FOR INJECTING FUEL INTO CYLINDER COMBUSTION CHAMBERS OF AN INTERNAL COMBUSTION ENGINE, AND AN INJECTOR WITH SUCH A NOZZLE NEEDLE

(71) Applicant: Continental Automotive GmbH, Hannover (DE)

(72) Inventors: Stephan Aurich, Neukirchen (DE); Carsten Hampel, Pirna Copitz (DE); Thomas Sarfert, Glauchau (DE); Ferdinand Loebbering, Alteglofsheim (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 192 days.

(21) Appl. No.: 14/369,884

(22) PCT Filed: Dec. 19, 2012

(86) PCT No.: PCT/EP2012/076195
§ 371 (c)(1),
(2) Date: Jun. 30, 2014

(87) PCT Pub. No.: WO2013/098163
PCT Pub. Date: Jul. 4, 2013

(65) Prior Publication Data

US 2015/0122918 A1 May 7, 2015

(30) Foreign Application Priority Data

Dec. 30, 2011 (DE) ..... 10 2011 090 148

(51) Int. Cl.
*F02M 51/00* (2006.01)
*F02M 61/12* (2006.01)
(Continued)

(52) U.S. Cl.
CPC ..... *F02M 61/12* (2013.01); *F02M 51/0675* (2013.01); *F02M 51/0678* (2013.01);
(Continued)

(58) Field of Classification Search
CPC ... F02M 61/162; F02M 61/163; F02M 61/168
(Continued)

(56) References Cited

U.S. PATENT DOCUMENTS 1,814,443 A * 7/1931 Goldberg ..... F02M 61/04 137/510
5,072,885 A * 12/1991 Hans ..... B23P 13/00 239/466
(Continued)

FOREIGN PATENT DOCUMENTS

DE 19813454 A1 10/1999 ..... F02M 47/02
EP 0982493 A1 3/2000 ..... B23P 15/16
(Continued)

OTHER PUBLICATIONS

International Search Report and Written Opinion, Application No. PCT/EP2012/076195, 15 pages, Mar. 1, 2013.

*Primary Examiner* — Arthur O Hall
*Assistant Examiner* — Viet Le
(74) *Attorney, Agent, or Firm* — Slayden Grubert Beard PLLC

(57) ABSTRACT

A nozzle needle for an injector for injecting fuel includes at least one guiding section with a recess and a guiding surface configured to rest against an inner surface of a nozzle body of the injector, the recess at least partially delimiting the guiding surface and being configured to allow a flow of fuel along the guiding section, and the guiding surface being guided about the longitudinal axis of the nozzle needle in a helical manner.

16 Claims, 4 Drawing Sheets

(51) Int. Cl.
*F02M 51/06* (2006.01)
*F02M 61/16* (2006.01)

(52) U.S. Cl.
CPC ..... *F02M 61/163* (2013.01); *F02M 61/168* (2013.01); *Y10T 29/49432* (2015.01)

(58) Field of Classification Search
USPC ..... 239/466, 472
See application file for complete search history.

(56) References Cited

U.S. PATENT DOCUMENTS

| | | | | |
|---|---|---|---|---|
| 6,477,940 | B1 | 11/2002 | Danckert et al. | 92/172 |
| 7,028,976 | B2 * | 4/2006 | Bachmann | F02M 61/163 251/126 |
| 2003/0168531 | A1 | 9/2003 | Maier | 239/587.1 |

FOREIGN PATENT DOCUMENTS

| | | | | |
|---|---|---|---|---|
| GB | 676535 | A | 7/1952 | F02M 61/06 |
| JP | 02125960 | A | 5/1990 | F02D 41/02 |
| JP | 10176631 | A | 6/1998 | F02M 61/10 |
| JP | 10311264 | A | 11/1998 | F02M 51/06 |
| WO | 02/38939 | A2 | 5/2002 | F02M 51/06 |
| WO | 2013/098163 | A1 | 7/2013 | F02M 51/06 |

* cited by examiner

NOZZLE NEEDLE FOR AN INJECTOR FOR INJECTING FUEL INTO CYLINDER COMBUSTION CHAMBERS OF AN INTERNAL COMBUSTION ENGINE, AND AN INJECTOR WITH SUCH A NOZZLE NEEDLE

CROSS-REFERENCE TO RELATED APPLICATIONS

This application is a U.S. National Stage Application of International Application No. PCT/EP2012/076195 filed Dec. 19, 2012, which designates the United States of America, and claims priority to DE Application No. 10 2011 090 148.5 filed Dec. 30, 2011, the contents of which are hereby incorporated by reference in their entirety.

TECHNICAL FIELD

The invention concerns a nozzle needle for an injector for injecting fuel, and an injector with such a nozzle needle, having at least one guide portion and a recess with a guide surface, wherein the guide surface is configured to rest on an inner face of a nozzle body of the injector, and the recess at least partially delimits the guide surface and is configured to allow a fuel flow along the guide portion.

BACKGROUND

Nozzle needles are known for injectors for injecting fuel into cylinder combustion chambers of an internal combustion engine, which have a guide portion. The guide portion here has guide surfaces which are separated from each other by recesses. The guide surfaces serve to lie on an inner face of the nozzle body of the injector and guide the nozzle needle in its stroke movement. The recesses are provided to allow fuel to flow by, along the nozzle needle in the nozzle body, parallel to the longitudinal axis of the nozzle needle. The recesses are normally oriented parallel to a longitudinal axis of the nozzle needle and are usually formed in the nozzle needle by ground grooves or by removal of the circumferential surface into a three- or four-sided profile by material removal in a hard-machining process.

SUMMARY

One embodiment provides a nozzle needle for an injector for injecting fuel, having at least one guide portion and a recess with a guide surface, wherein the guide surface is configured to rest on an inner face of a nozzle body of the injector, and the recess at least partly delimits the guide surface and is configured to allow a fuel flow along the guide portion, wherein the guide surface is guided in a helical manner about the longitudinal axis of the nozzle needle.

In a further embodiment, the at least one guide surface overlaps with itself or with a further guide surface on a projection in a projection plane which is arranged at right angles to the longitudinal axis of the nozzle needle.

In a further embodiment, the at least one guide surface forms a closed circuit in the projection plane.

In a further embodiment, the guide surface extends substantially over an angular segment of 60° to 90°, in particular from 65° to 75° in the projection plane.

In a further embodiment, the guide portion has at least one guide tooth which is guided in a helical manner about the longitudinal axis, wherein the guide surface is arranged radially on the outside at the guide tooth.

In a further embodiment, the guide tooth has an involute toothing.

In a further embodiment, the ratio of the area of the recess to the total area of the nozzle needle in the profile section is 0.15 to 0.30, in particular 0.18 to 0.25.

In a further embodiment, the guide surface has a width in relation to an angular segment established by the guide surface, in the peripheral direction of the nozzle needle, of 1.5° to 5°, in particular 2° to 3°, in particular 2.2° to 2.3°.

In a further embodiment, the guide portion can be produced in the nozzle needle by means of cold forming, in particular by means of rolling.

Another embodiment provides an injector for injecting fuel into the cylinder combustion chambers of an internal combustion engine, with a nozzle body with an inner face and a nozzle needle as disclosed above, wherein the guide surface of the nozzle needle lies at least partly on the inner face of the nozzle body and guides the nozzle needle in its movement.

Another embodiment provides a method for production of a nozzle needle for an injector for injecting fuel into the cylinder combustion chambers of an internal combustion engine, wherein a base body of the nozzle needle is soft-machined, in particular turned, wherein at least one recess and at least one guide surface are produced in the base body of the nozzle needle by rolling, wherein the base body is annealed, and wherein the guide surface of the guide portion is hard-machined, in particular hard-turned or ground.

BRIEF DESCRIPTION OF THE DRAWINGS

Example embodiments are discussed below with reference to the drawings, in which.

DETAILED DESCRIPTION

Figure 1:
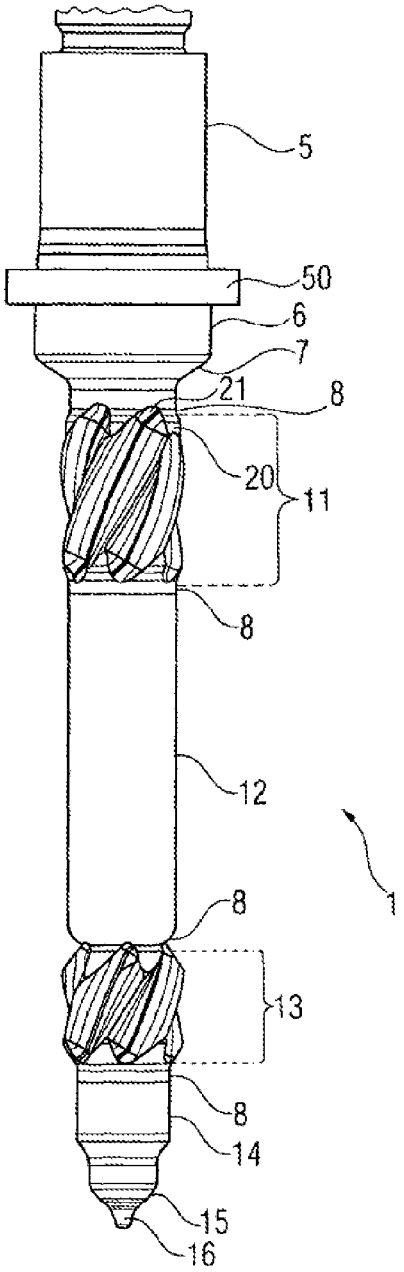
FIG. 1 shows a side view of a nozzle needle.

Embodiments of the invention allow an improved stabilization of the nozzle needle in the nozzle body of the injector, and simpler production of the nozzle needle.

In some embodiments the nozzle needle has a guide portion to guide the nozzle needle in a stroke movement parallel to a longitudinal axis in a nozzle body of the injector, wherein the guide portion comprises at least one guide surface and a recess.

The guide surface lies on an inner face of the nozzle body of the injector. The guide surface is guided in a helical manner about the longitudinal axis of the nozzle needle, so as to obtain an improved support of the nozzle needle inside the nozzle body of the injector. The recess is configured to allow a fuel flow along the guide portion of the nozzle needle. Furthermore, deaxialization is minimized due to the helical design of the guide surface and the mutual offset in relation to possible further guide portions.

In a further embodiment, the at least one guide surface overlaps with itself or a further guide surface on a projection in a projection plane which is arranged at right angles to the longitudinal axis of the nozzle needle, so that the nozzle needle can be stabilized particularly well.

It may be particularly advantageous for stabilizing the nozzle needle if the guide surface and the further guide surface form a closed circuit in the projection plane.

In a further embodiment, the guide surface extends substantially over an angular segment from 60° to 90°, in particular from 65° to 75° in the projection plane, so as to ensure a reliable support of the nozzle needle even over a small number of guide surfaces.

In a further embodiment, the guide portion has at least one guide tooth which is guided in a helical manner about the longitudinal axis of the nozzle needle, wherein the guide surface is arranged radially on the outside at the guide tooth.

Due to the formation of the guide surface at the guide tooth, fuel can be transported reliably along the nozzle needle on its path over the guide portion along the guide tooth.

In a further embodiment, the guide tooth has an involute toothing. In this manner, the guide tooth can easily be produced in the nozzle needle by a cold forming process.

In a further embodiment, the ratio of the area of the recess of the guide portion to a total area of the nozzle needle in the profile section or in the profile plane is 0.15 to 0.30, in particular between 0.18 and 0.25, so that a pressure reduction on delivery of fuel along the nozzle needle, along the guide portion through the recess, is kept small.

In a further embodiment, the guide portion is produced in the nozzle needle by means of cold forming, in particular by means of the rolling production process. In this way, the nozzle needle can economically be produced even in large series.

Other embodiments provide a method for production of a nozzle needle. For this a base body of the nozzle needle is soft-machined, in particular turned, in order to give the nozzle needle a predefined base form. To form the guide portion or produce at least one recess and at least one guide surface, a tool with negative form is rolled on the base body of the nozzle needle and thus the shape of the guide portion, or its guide surface and the recess, is produced in the nozzle needle. The base body of the nozzle needle is annealed and then at least the guide surfaces are hard-machined, in particular hard-turned or ground. In this way the nozzle needle can be produced economically since the guide surface or the recess of the guide portion can be produced by means of an economic soft machining of the base body of the nozzle needle. This reduces the cycle time in production of the nozzle needle.

Figure 2:
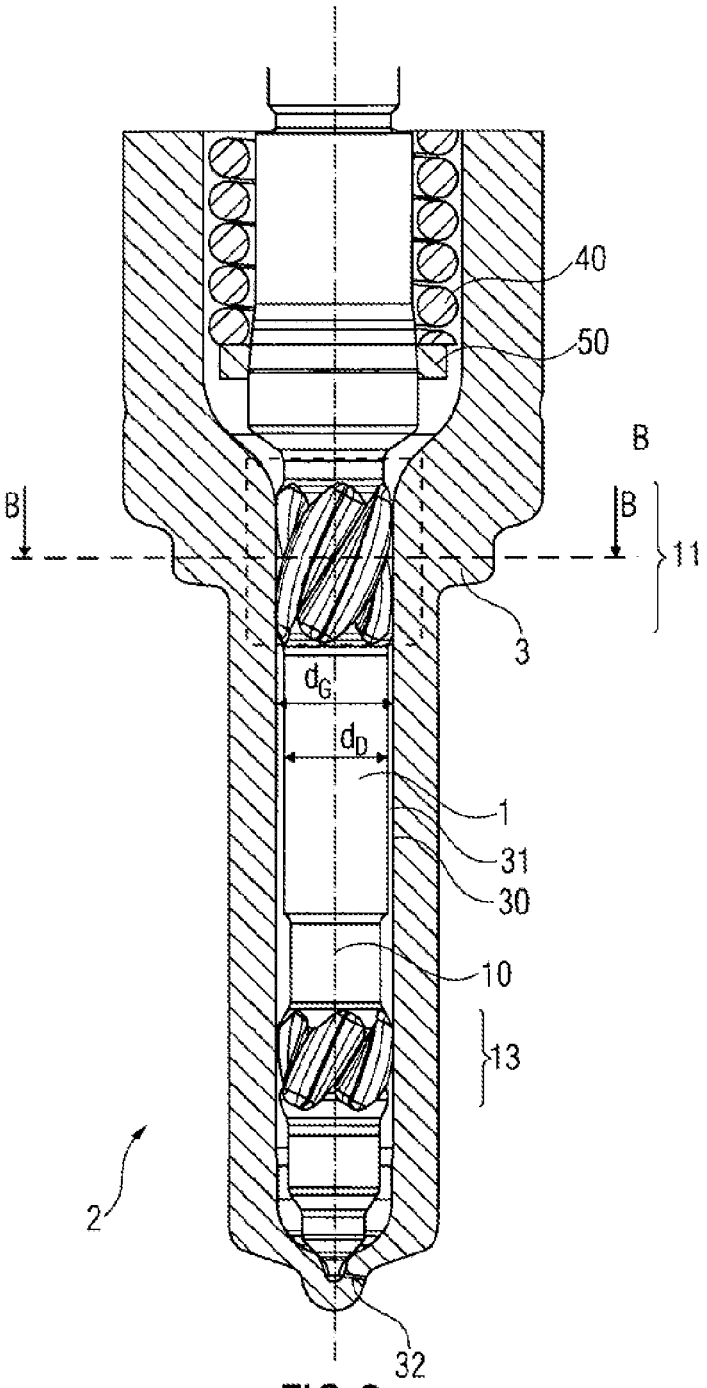
FIG. 2 shows a section view of an injector with the nozzle needle shown in FIG. 1.

FIG. 1 shows a side view of a nozzle needle 1, and FIG. 2 shows a longitudinal section through an injector 2 with a nozzle needle 1 shown in FIG. 1.

The nozzle needle 1 has a spring portion 5 which in mounted state is surrounded by a spring 40 in the injector 2. Adjacent to this is a pressing portion 6, on which a ring 50 is pressed in mounted state of the injector 2. The ring 50 serves to transfer twist forces from the spring 40 into the nozzle needle 1. Downwards from the pressing portion 6, the nozzle needle 1 tapers over the tapering segment 7 towards a constriction 8. A first guide portion 11 is arranged adjacent to this. On the underside, the first guide portion 11 is delimited by a further constriction 8, to which a shaft 12 is attached. This is followed by a second guide portion 13 which is delimited by further constrictions 8 on both sides. A further shaft 14 is arranged from the bottom constriction 8. After this, the nozzle needle 1 tapers over several conical portions towards a tip 16 of the nozzle needle 1. A seat region 15 is provided between the further shaft 14 and the tip 16, and lies on the nozzle body 3 of the injector 2 when the injector 2 is in the closed position.

The injector is configured for injecting fuel into the cylinder combustion chambers of an internal combustion engine. Both the injection time and the fuel quantity to be injected are determined by a position of the nozzle needle 1 in the injector 2. To control the injection process, the nozzle needle 1 is raised and lowered along its longitudinal axis 10 in a nozzle body 3 of the injector.

The first guide portion 11 and the second guide portion 13 serve to guide the nozzle needle in the nozzle body 3 of the injector in its stroke movement and to prevent an axial deflection of the nozzle needle 1 on its stroke movement. Furthermore in an intermediate space 31 between the nozzle body and the peripheral surface of the nozzle needle 1, fuel is delivered to the tip 16 of the nozzle needle 1 and, when the nozzle needle is in the open position, injected into the cylinder combustion chamber under high pressure via an opening 32 at the lower end of the injector 2.

Figure 3:
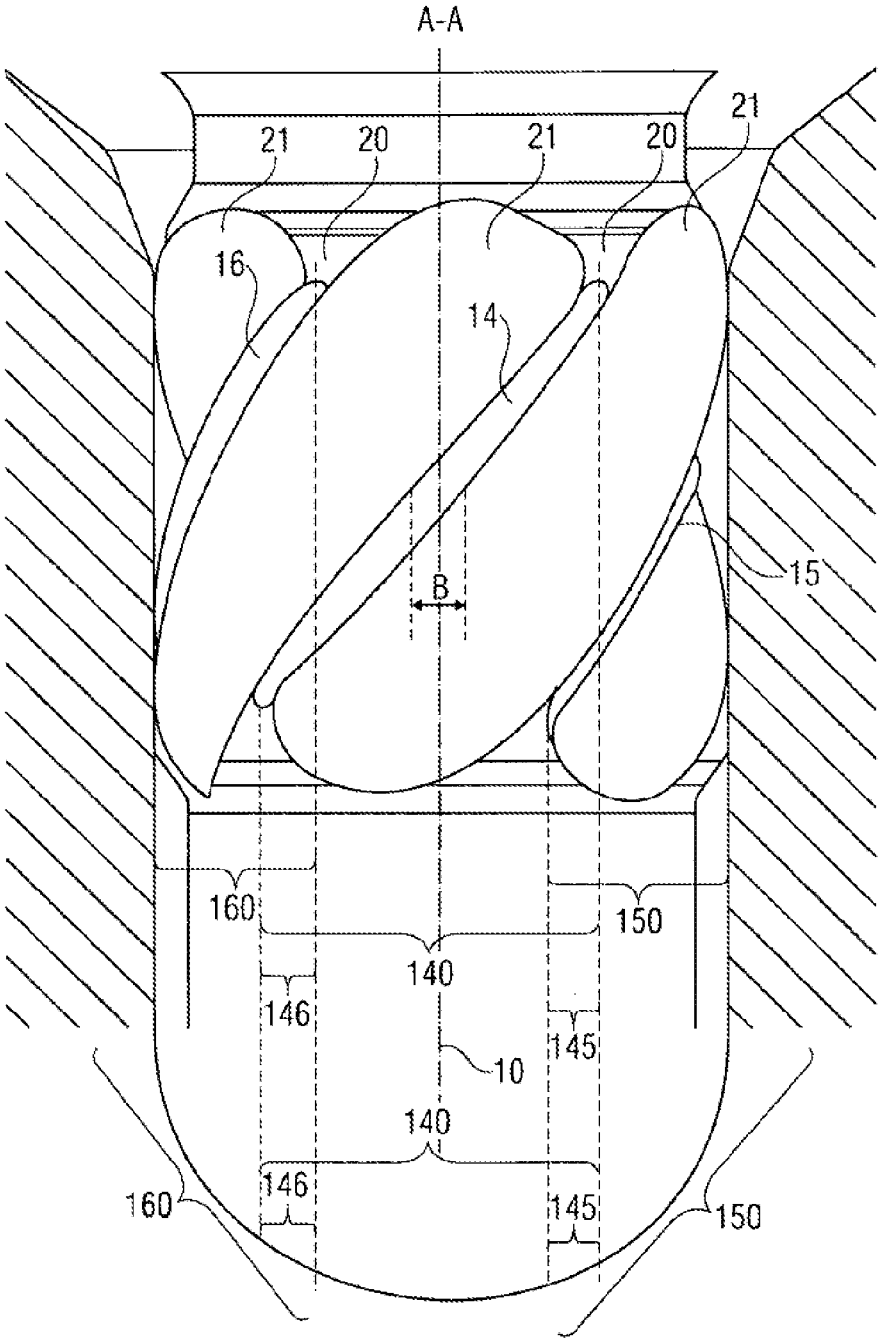
FIG. 3 shows a partial extract from the injector shown in FIG. 2 with a guide portion of the nozzle needle.
Figure 4:
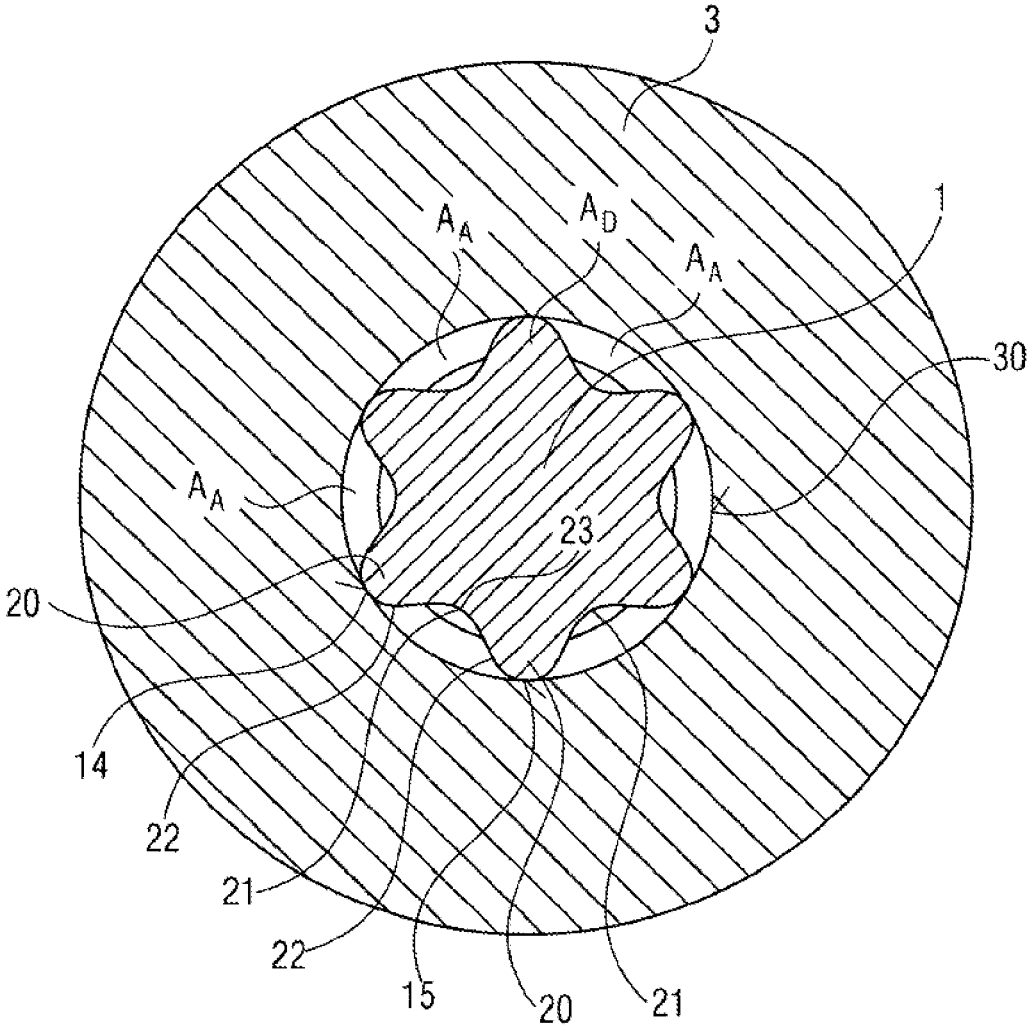
FIG. 4 shows a cross section through the injector and the nozzle needle in the region of the guide portion.

FIG. 3 shows an extract from the injector 2 which is indicated in dotted lines in FIG. 2, and FIG. 4 shows a cross section through the injector 2 along a section plane B-B shown in FIG. 2. The guide portion 11 comprises several guide teeth 20 which are separated from each other by individual recesses 21. The guide teeth 20 have the contour of an involute toothing, so that the teeth flanks 32 of the guide teeth 20 are convex and the tooth base 23 is formed concave. A guide surface 14, 15, 16 is arranged lying radially on the outside at each of the guide teeth 20. A first guide surface 14 or a second guide surface 15 or a third guide surface 16 each have a predefined width B defined in the peripheral direction of the nozzle needle 1. Preferably the width of the guide surface 14, 15, 16 in the peripheral direction of the nozzle needle 1, in relation to an angular segment established by the guide surface 14, 15, 16, is 1.5° to 5° wide. Advantageously width B in particular is between 2° and 3°, in a particularly advantageous embodiment between 2.2° and 2.3°.

The guide teeth 20 or the guide surfaces 14, 15, 16 and the recesses 21 are arranged in a helical manner in relation to the longitudinal axis on the peripheral surface of the nozzle needle 1. The recesses 21 are provided in the first guide portion 11 to provide a fuel flow along the first guide portion 11, from the top in the FIGS. 2 and 3 in the direction of the tip 16 of the nozzle needle 1.

In mounted state of the nozzle needle 1, the guide surfaces 14, 15, 16 lie on an inner face, in this embodiment on a corresponding inner circumferential face 30 of the nozzle body 3. Each guide surface 14, 15, 16 encloses a corresponding guide segment 140, 150, 160. The contact of the guide surfaces 14, 15, 16 stabilizes the nozzle needle 1 in its stroke movement, i.e. in the movement in the direction of longitudinal axis 10, which overlaps with a longitudinal axis of the injector 2 (not shown). The helical configuration of the guide surfaces 14, 15, 16, despite a small width B of the guide surfaces 14, 15, 16, increases the width of the guide segment 140, 150, 160 corresponding to the respective guide surface 14, 15, 16, so that the nozzle needle 1 makes contact in a broad angular or circumferential segment of the nozzle needle 1 and is therefore guided reliably in its stroke movement.

FIG. 3 furthermore shows with dotted lines a projection plane A-A which is arranged at right angles to the longitudinal axis 10, or the plane vector of which runs parallel to longitudinal axis 10. If the guide surfaces 14, 15, 16 are projected into projection plane A-A (shown below the extract from the injector 2 in FIG. 3), each guide segment 14, 15, 16 depicts a corresponding circle segment. It is particularly advantageous for stabilizing the nozzle needle 1 if the corresponding circle segments overlap in the projection plane A-A.

In an overlap region 145, 146 between a first guide segment 140 and a second guide segment 150, or between the first guide segment 140 and a third guide segment 160, the first guide surface 14 and the second and third guide surfaces 15 and 16 lie axially at the same height at the inner circumferential face 30 of the nozzle body 3 of the injector 2. Thus for example for a first overlap region 145 between the first guide segment 140 and the second guide segment 150, the first guide surface 14 in an upper region of the first guide portion 11, and the second guide surface 15 in a lower region of the guide surface 15, lie at axially the same height at the inner circumferential face 30 of the nozzle body 3 of the injector 2. This further stabilizes the nozzle needle and prevents the deaxialization of the nozzle needle 1.

To guarantee an overlap, the guide teeth 20 or the radially outermost guide surfaces 14, 15, 16 have a pitch of 17° to 25°, in particular from 20° to 22°. Because of the number of six guide teeth 20 selected in this embodiment in the first guide segment 11, the guide surfaces 14, 15, 16 overlap in the projection plane A-A through the projected guide segments 140, 150, 160 such that in the projection plane A-A, they form a closed circuit. In this way, a particularly good stabilization of the nozzle needle 1 by the first guide portion 11 is possible.

In a particularly advantageous configuration of this embodiment, the guide surfaces 14, 15, 16 or the corresponding guide segments 140, 150, 160 each enclose an angular segment of 60° to 90°, in particular from 65° to 75°. It is also conceivable that the guide surfaces completely wind at least once around the nozzle needle and thus enclose an angular segment of at least 360°. This would have the consequence that, for an angular segment of more than 360°, the guide surface would overlap with itself in the projection plane A-A.

The second guide portion 13 shown in FIGS. 1 and 2 is formed similarly to the first guide portion 11. The only difference of the second guide portion 13 from the first guide portion 11 is that the axial extension of the second guide portion 13 in the direction of the longitudinal axis 10 is shorter than that of the first guide portion 11. With the same pitch of the guide surfaces of the second guide portion 13, this has the consequence that these, or the guide segments they enclose, do not overlap in the projection plane B-B.

In order to guarantee an overlap of the guide segments corresponding to the guide surfaces in the second guide portion 13, it would be conceivable to increase the pitch of the guide surfaces or guide teeth or increase the axial extension of the second guide portion 13.

In this embodiment, the pitch of the two guide portions 11, 13 is the same. Alternatively it is also conceivable to select opposing pitches, in order to reduce an eddying of the fuel in the intermediate space 31 between the nozzle body 3 and the nozzle needle 1 due to the first guide portion 11, or adapt to a desired atomization of the fuel on the injection process.

Also, in this embodiment two guide portions 11, 13 are provided which are physically separated from each other by the shaft 12. In this way the deaxialization of the nozzle needle 1 can be reduced. Alternatively it is also conceivable to merge the two guide portions 11, 13 into one guide portion with no physical separation, in order to provide a reliable guidance of the nozzle needle 1.

To allow an adequate fuel flow at the guide portions 11, 13, the ratio of all combined areas $A_A$ of recesses 21 to a total area $A_D$ of the nozzle needle in the profile section B-B (see FIG. 4) is 0.15 to 0.30, but in particular 0.18 to 0.25. In this way it can be guaranteed that the fuel flow to the tip 16 of the injector 2 is not adversely affected by the guide portion 11, 13. Furthermore, the fuel serves as lubrication at the guide surfaces 14, 15, 16 up to the inner circumferential face 30 of the nozzle body 3 of the injector 2, in order to prevent increased wear between the nozzle needle 1 and the nozzle body 3.

To produce the nozzle needle 1 in a base body (not shown) or a blank, the nozzle needle 1 is given a basic shape by soft machining, in particular by turning. After turning, the first guide portion 11 or the second guide portion 13 can be produced by cold forming, in particular by rolling. Here it is particularly advantageous if only a single tool is used to roll the first guide portion 11 and second guide portion 13, so that both guide portions 11, 13, or their recesses 21 and the guide surfaces 14, 15, 16, can be produced in the nozzle needle 1 in one production step. In order to allow the material displaced on rolling to escape, the constrictions 8 are provided at the top and bottom of the first guide portion 11 and second guide portion 13. During rolling, the material of the base body is displaced into this constriction 8 without the shaft 12 thickening and thus reducing a predefined distance between the nozzle needle 1 and the inner circumferential face 30 of the nozzle body 3 due to bead formation. Here the selection of an involute toothing for the guide portion 11, 13 is of particular advantage, since here the tool substantially rolls on the nozzle needle 1 and a slip process between the tool and the nozzle needle 1 is avoided. This results in a high machining accuracy and in low wear on the tool.

Alternatively it is conceivable to roll a corresponding guide portion 11, 13 each with a separate tool, in order thus to be able to accommodate any necessary geometry differences, in particular a different pitch, during production.

Following rolling, the base body of the nozzle needle 1 is annealed i.e. subjected to heat treatment in order to give the surface of the nozzle needle 1 the properties necessary for the operating conditions, in particular a predefined hardness. Then the first guide portion 11 and second guide portion 13, the seat region 15 and the pressing portion 6, are machined by means of hard machining, in particular by means of a hard turning process or a grinding process, to guarantee a high dimensional accuracy and surface quality of said portions 6, 11, 13, 15.

Although the invention has been illustrated and described in detail in the form of the preferred exemplary embodiment, the invention is not restricted by the examples disclosed and other variations can be derived by the person skilled in the art without leaving the scope of protection of the invention.

What is claimed is:

1. A nozzle needle for an injector for injecting fuel, comprising:

a shaft having a spring portion and a tip, the shaft tapering progressively from a first radius at the spring portion to a smaller second radius at the tip, two guide portions disposed along the shaft, each extending to a guide portion radius beyond a respective local radius of the shaft, and one or more guide surfaces in each guide portion, wherein the one or more guide surfaces rest on an inner face of a nozzle body of the injector, wherein the one or more guide surfaces allow a fuel flow along the shaft past the guide portion, wherein the one or more guide surfaces extend in a helical manner about the longitudinal axis of the nozzle needle and, when viewed in cross-section along a longitudinal axis of the shaft, a ratio of open areas between the one or more guide surfaces to a total area of the nozzle needle is between 0.15 and 0.30.

2. The nozzle needle of claim 1, wherein each guide surface overlaps with itself or with another guide surface on a projection in a projection plane which is arranged at right angles to the longitudinal axis of the nozzle needle.

3. The nozzle needle of claim 2, wherein each guide surface extends substantially over an angular segment of between 60° and 90° in the projection plane.

4. The nozzle needle of claim 1, wherein each guide portion has at least one guide tooth extending in a helical manner about the longitudinal axis, wherein the guide surface is disposed radially on the outside at the guide tooth.

5. The nozzle needle of claim 4, wherein the guide tooth has an involute toothing.

6. The nozzle needle of claim 4, wherein a ratio of an arc length of the recess to a circumference of the nozzle needle in the profile section is between 0.15 and 0.30.

7. The nozzle needle of claim 1, wherein each guide surface covers an arc of the nozzle needle, of between 1.5° and 5°.

8. The nozzle needle of claim 1, wherein the two guide portions are produced by cold rolling.

9. An injector for injecting fuel into the cylinder combustion chambers of an internal combustion engine, comprising:

a nozzle body with an inner face, and a nozzle needle comprising:

a shaft having a spring portion and a tip, the shaft tapering from a first radius at the spring portion to a smaller second radius at the tip, two guide portions along the shaft, each extending beyond a respective local radius of the shaft, and one or more guide surfaces in each guide portion, wherein the one or more guide surfaces rest on the inner face of a nozzle body of the injector, wherein the one or more guide surfaces allow a fuel flow along the shaft past the guide portion, wherein the one or more guide surfaces extend in a helical manner about the longitudinal axis of the nozzle needle and, when viewed in cross-section along a longitudinal axis of the shaft, a ratio of open areas between the one or more guide surfaces to a total area of the nozzle needle is between 0.15 and 0.30, and wherein the guide surface of the nozzle needle lies at least partly on the inner face of the nozzle body and guides the nozzle needle in its movement.

10. The injector of claim 9, wherein each of the one or more guide surfaces overlaps with itself or with another of the one or more guide surfaces on a projection in a projection plane which is arranged at right angles to the longitudinal axis of the nozzle needle.

11. The injector of claim 10, wherein each guide surface extends substantially over an angular segment of between 60° and 90° in the projection plane.

12. The injector of claim 9, wherein each guide portion has at least one guide tooth extending in a helical manner about the longitudinal axis, wherein the guide surface is disposed radially on the outside at the guide tooth.

13. The injector of claim 12, wherein the guide tooth has an involute toothing.

14. The injector of claim 12, wherein a ratio of an arc length of the recess to a circumference of the nozzle needle in the profile section is between 0.15 and 0.30.

15. The injector of claim 9, wherein the guide surface covers an arc of the nozzle needle, of between 1.5° and 5°.

16. The injector of claim 9, wherein the guide portion is produced by cold rolling.

* * * * *